United States Patent [19]

Perri

[11] Patent Number: 4,783,059

[45] Date of Patent: Nov. 8, 1988

[54] TUYERE FOR TREATING MOLTEN METAL

[75] Inventor: Joseph A. Perri, Coraopolis, Pa.

[73] Assignee: Insul Company, Inc., East Palestine, Ohio

[21] Appl. No.: 141,911

[22] Filed: Jan. 11, 1988

[51] Int. Cl.[4] ..... C21C 5/48

[52] U.S. Cl. ..... 266/266; 266/218

[58] Field of Search ..... 266/218, 225, 265, 266, 266/270

[56] References Cited

U.S. PATENT DOCUMENTS

| | | | |
|---|---|---|---|
| 3,082,997 | 3/1963 | Kurzinski | 266/225 |
| 3,645,520 | 2/1972 | Acre et al. | 266/225 |
| 3,898,078 | 8/1975 | Huber | 266/225 |
| 3,967,955 | 7/1976 | Folgerö et al. | 75/10.17 |
| 4,211,553 | 7/1980 | Honkaniemi et al. | 75/93 R |
| 4,427,186 | 1/1984 | Bührmann | 266/270 |

FOREIGN PATENT DOCUMENTS

| | | | |
|---|---|---|---|
| 70709 | 4/1984 | Japan | 266/266 |
| 46313 | 3/1985 | Japan | 266/266 |
| 1006501 | 3/1983 | U.S.S.R. | 266/266 |

*Primary Examiner*—L. Dewayne Rutledge
*Assistant Examiner*—Robert L. McDowell
*Attorney, Agent, or Firm*—Harpman & Harpman

[57] ABSTRACT

A tuyere for treating molten metal in a vessel in which bottom stirring gas blowing is desired has a tubular body member having a mounting flange inwardly of one end thereof by which the tuyere is positioned in the vessel through an opening in a side wall thereof with the inner end of the tuyere spaced with respect to the side wall to effectively direct gas introduced therethrough in a stirring action in the molten metal. A plurality of spirally wound metal tubes are positioned in side by side relation engaging the tubular body member and the plurality of spirally wound metal tubes are partially flattened to create desirable configurations so that a tuyere so formed can match any desired discharge of gas into the molten metal. Additionally, the partially flattened configuration of the smaller tubes enables them to provide relatively large surface areas engageable against the inner surface of the tubular body member which imparts a cooling effect thereto. The spirally wound tubes are mechanically locked into a refractory forming a core in the tubular body member and the delivery end of the tuyere positions the ends of the spirally wound tube in a circular pattern which provides a tangential flow of gas therefrom when gas is directed therethrough. The spirally wound tubes extend continuously inwardly of the delivery end of the tuyere to a point inwardly of the opposite end thereof where they continue longitudinally and communicate with apertures in a partition defining one wall of a gas receiving chamber.

6 Claims, 2 Drawing Sheets

TUYERE FOR TREATING MOLTEN METAL

BACKGROUND OF THE INVENTION

1. Technical Field:

This invention relates to tuyeres such as used for introducing gas or oxygen into molten metal in a vessel adjacent the bottom thereof for stirring or refining a molten bath of steel making composition.

2. Description of the Prior Art:

Tuyeres for introducing gases into baths of molten metal for various purposes are disclosed in U.S. Pats. Nos. 3,898,078, 3,967,955, and 4,211,553.

U.S. Pat. No. 3,898,078 illustrates in FIG. 3 of the drawings a vessel containing molten metal in which a tuyere or a nozzle 10 is positioned in a side wall thereof adjacent the bottom of the vessel.

U.S. Pat. No. 3,967,955 discloses a tuyere positioned in a converter through a side wall thereof, and U.S. Pat. No. 4,211,553 in FIG. 3 thereof illustrates a tuyere positioned through the side wall of a vessel so as to introduce gas into the vessel adjacent the bottom thereof.

Many variations of tuyere constructions are known in the prior art, the majority of which simply introduce either a stirring or blowing gas or a refining gas, such as oxygen, into molten metal in vessels including converters, ladles, and the like. The above-mentioned U.S. Pat. No. 3,898,078 discloses a device operable as a tuyere in introducing oxygen as a refining agent into molten metal through a large straightaway passageway defined by a pair of tubular members, one of which is spaced within the other and provided with a thickened end portion in which helical passageways are formed as by machining. Fuel, such as oil, forms a cooling agent directed through the helical passageways and is discharged into the molten metal along with oxygen flowing through the axial passageway. The swirling motion created by the oil flowing from the helical passageway enhances the atomization of the oil necessary in increasing combustion efficiency of the oil forming a hydrocarbon fuel in the steel refining process.

The present invention is not used as a means of introducing a hydrocarbon fuel into a metal bath, but rather introducing either a gas as an agent creating a desirable bottom stirring in the metal bath and/or introducing a refining agent such as oxygen. The refractory core formed in the tubular body member and within several spirally wound metal tubes and their longitudinally extending sections mechanically locks the same in desired contacting arrangement with the tubular body member of the tuyere and the open ends of the tubular body members which are flattened to form volume controlling valves and jet configurations of the gas delivered therefrom provide a tangential flow of the gas which causes a circular stirring motion in the molten metal bath.

SUMMARY OF THE INVENTION

A tuyere for treating molten metal by introducing inert gas for stirring or for injecting oxygen or another gas into molten metal or a slag has a tubular body member in which a plurality of smaller metal tubes extend longitudinally through a portion of their length and continuously extend in a spirally wound pattern with each of the smaller tubes being partially flattened transversely and positioned with their flattened surfaces in contact with the inner surface of the tubular body member. The spirally wound tubes terminate at the delivery end of the lance along with the tubular body member and they are positioned within the tubular body member by a refractory core formed therein. A partition inwardly of the end opposite the delivery end of the tuyere has apertures in which the smaller metal tubes are affixed, the partition forming a gas chamber into which a desirable gas for introduction into the molten metal bath is introduced.

DESCRIPTION OF THE PREFERRED EMBODIMENT

Figure 1:
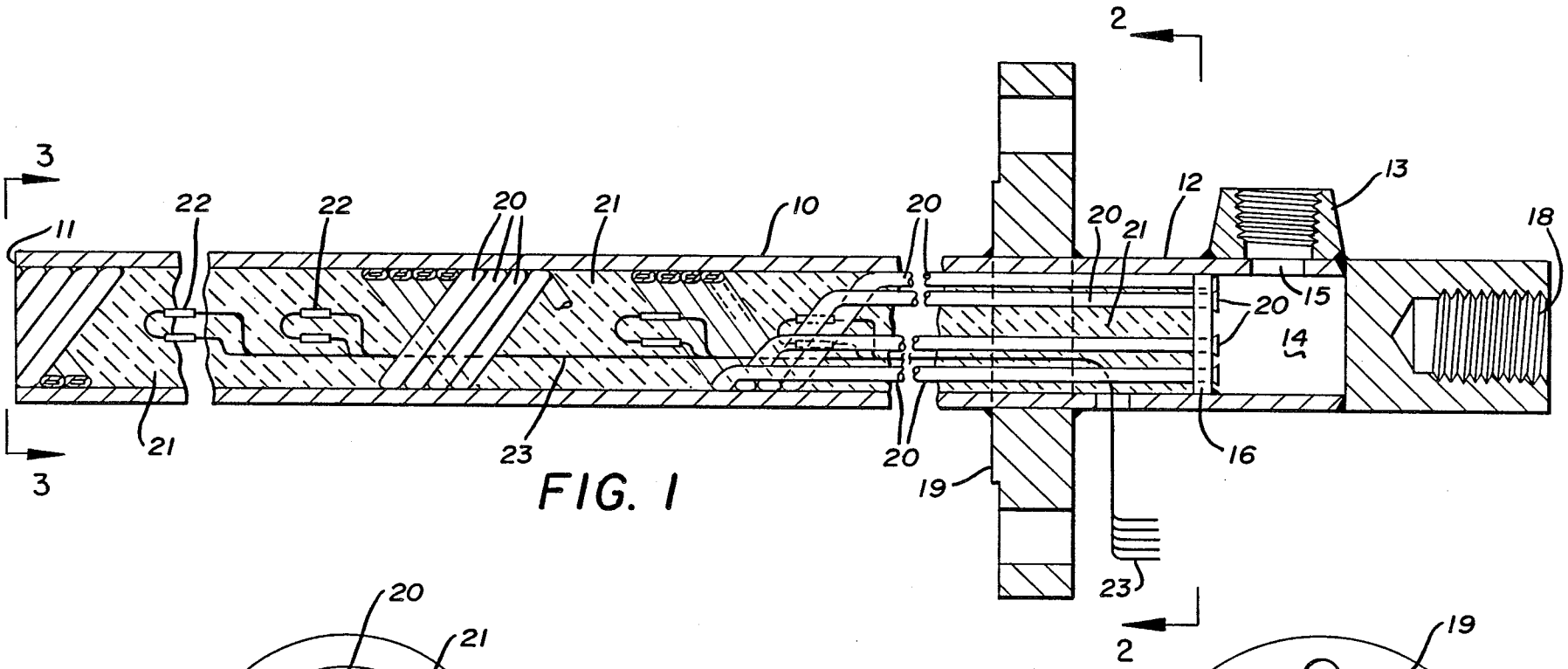
FIG. 1 is a vertical section through the tuyere with parts broken away to illustrate the construction thereof.

In the form of the invention illustrated and described herein the tuyere for treating molten metal comprises an elongated tubular body member 10, an end 11 of which comprises a discharge or tip end, and an opposite end 12 forms an inlet. A fitting 13 communicates with a chamber 14 in the inlet end 12 by way of an aperture 15. One wall of the chamber 14 is formed by a partition 16 and a closure body 17 forms another wall. A drilled and tapped opening 18 in the closure body 17 provides means of attaching a device for holding and/or adjustably positioning the tuyere. A mounting flange 19 is affixed to the tubular body member 10 inwardly of the fitting 13 and is apertured circumferentially so that it can be used for securing the tuyere in desirable position in an opening in the side wall of a molten metal containing vessel or the like.

The partition 16 is apertured in a circumferential pattern and a plurality of small metal tubes 20 are positioned in each of the apertures and extend longitudinally of the tubular body member 10 in a section thereof immediately inwardly of the apertured partition 16 and through the balance of the tubular body member 10 in a spiral pattern wherein each of the tubes 20 is partially flattened and wherein the partially flattened tubes 20 are positioned in engaging relation with the inner surface of the tubular body member 10. The spiral pattern continues to the discharge or tip end 11 where the open ends of the partially flattened small tubes 11 act to direct gas delivered therethrough in a series of circumferentially spaced tangentially directed paths.

Figure 3:
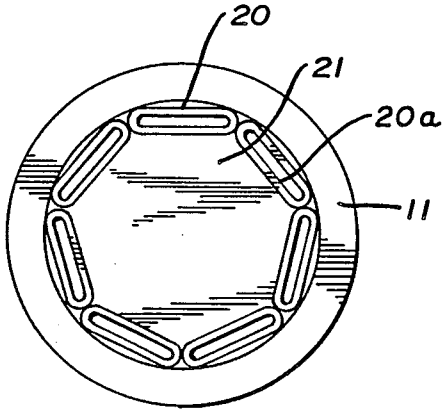
FIG. 3 is an end elevation on line 3—3 of FIG. 1.

By referring to FIG. 3 of the drawings, an enlarged end view of the discharge or tip end 11 of the tuyere may be seen and it will be observed that the ends of the several partially flattened small metal tubes 20 are arranged in a circular pattern which corresponds with the pattern of the spirally wound tubes within the metal body member 10 hereinbefore described.

Figure 2:
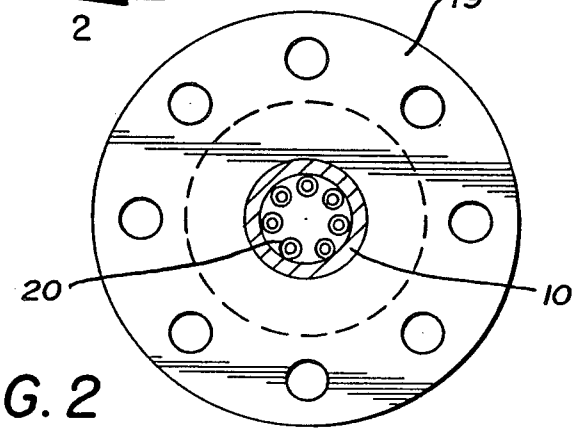
FIG. 2 is a cross sectional elevation on line 3—3 thereof.

Still referring to FIGS. 1 and 2 of the drawings, it will be seen that a refractory core 21 has been positioned in the tubular body member 10 and within the spiral formation of the small metal tubes 20 so as to mechanically lock the same in position, the core extending from the discharge or tip end 11 of the tuyere to the partition 16 hereinbefore referred to.

In FIG. 1 of the drawings, a plurality of erosion sensors 22 may be seen positioned longitudinally of the refractory core 21 and connected with conductors 23 which extend within the refractory core 21 to a point adjacent the partition 16 and then are directed outwardly thereof so as to communicate with devices indicating the presence or absence of the several sensors 22. The major portion of the tuyere is therefore supervised so that the rate of erosion thereof may be remotely determined by electrical circuits directed through the several sensors 22. The tuyere may erode to a point substantially inwardly of the disc or tip end 11 and still retain its effectiveness due to the continuously extending inward spiral pattern of the small tubes 20 through which the desirable gas is introduced into the molten metal bath. The tuyere is simply and easily formed and is capable of an unusually effective introduction of stirring or blowing gas into the molten metal bath when compared with the prior art tuyeres due to the novel and highly efficient arrangement of the circumferentially positioned semi-flattened metal tubes 20 creating relatively wide flat jet-way paths for the gas, each of which jets is tangentially directed relative to the tuyere and each of which semi-flattened metal tubes in its flattened oval shape is formed to match a desired rate of discharge of gas into the molten metal bath. For example, gas supplied at 300 lbs. per square inch can be desirably discharged at a rate of 200 feet per minute by preshaping the flattened oval shapes of the small metal tubes 20 by varying the width and length of the slot-like opening defined by the flattened oval shape.

Figure 4:
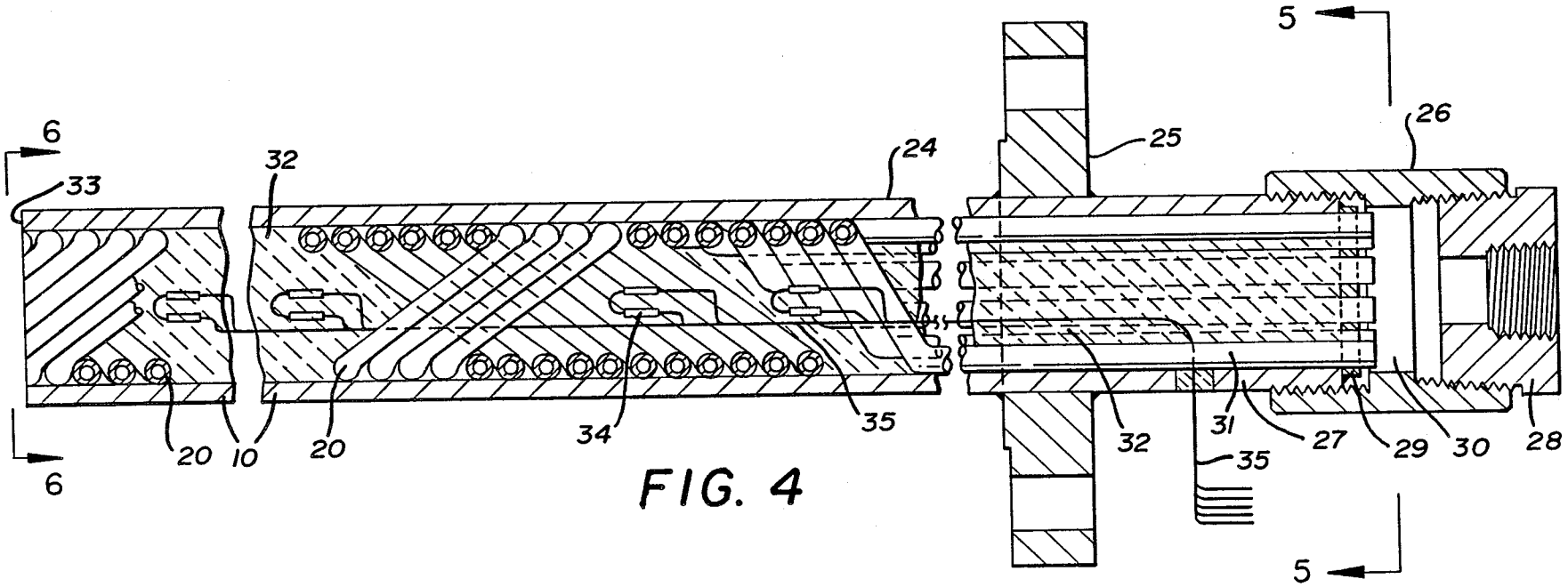
FIG. 4 is a vertical section through a modified form of the tuyere.

By referring now to FIG. 4 of the drawings, a modified form of the invention may be seen in which a tubular body member 24 is provided with an annular mounting flange 25 with a coupling 26 secured to an inlet end 27 of the tubular body member 24, the coupling 26 receives an apertured plug 28, the aperture thereof being threaded so as to receive and retain a tubular member through which gas is supplied to the tuyere. The apertured plug 28 and a transversely positioned partition 29 define a chamber 30 and a plurality of small tubes 31 communicate with the apertures in the partition 29 so that gas delivered into the chamber 30 will flow therethrough. The small metal tubes 31 inwardly of the apertured partition 29 extend longitudinally and then form a continuously spirally wound pattern engaging the inner surface of the tubular body member 24 and they are positioned by a refractory core 32 preferably cast therein, mechanically locked with small tubes 20 in the desired positioned in registry with the inner surface of the tubular body member 24. The spiral pattern of the small tubes 20 extends to the tip or discharge end 33 of the tuyere which may be seen in enlarged end elevation and wherein the tubes 20 are slightly flattened to form oval-shaped discharge orifices positioned circumferentially around an end of the refractory core 32.

Figure 5:
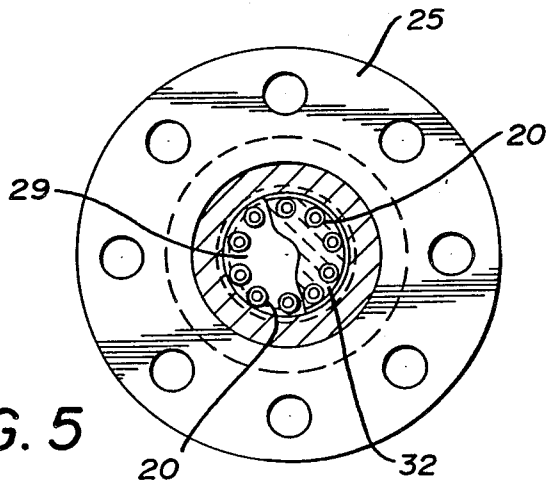
FIG. 5 is a vertical section on line 5—5 of FIG. 1.

In FIG. 5 of the drawings, a cross section on line 5—5 of FIG. 1, a portion of the apertured partition 29 is illustrated as being broken away to illustrate the refractory core 32 and the circumferential pattern of the tubes 20 positioned in the tuyere thereby. Sensors 34 are disposed longitudinally in the refractory core 32 and are connected with conductors 35 and extend outwardly of the tubular body member 24 where they communicate with indicating devices, not shown, for indicating the presence or absence of the sensors in the several electric circuits and thus indicating the effective length of the tuyere.

Figure 6:
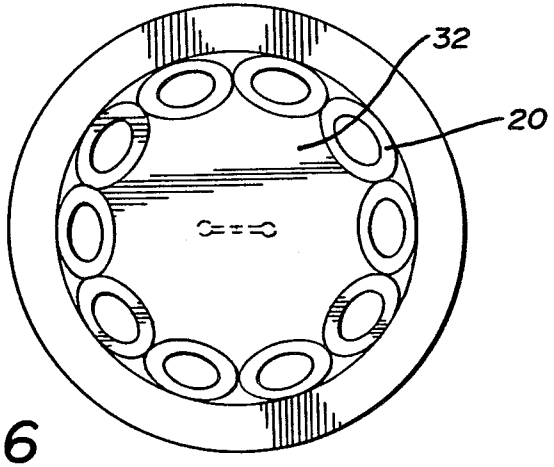
FIG. 6 is an end elevation on line 6—6 of FIG. 1.

The tuyere is simply and easily formed and as illustrated in FIGS. 4,5 and 6 of the drawings, may be attached to an end of a supporting and gas supplying tubular member providing a means of quickly and easily positioning the tuyere in and through an opening in the wall of a metallurgical vessel to position the tuyere in a desirable interior location therein with respect to a bath of molten metal therein.

Although but two embodiments of the present invention have been illustrated and described, it will be apparent to those skilled in the art that various changes and modifications may be made therein without departing from the spirit of the invention and;

Having thus described my invention what I claim is:

1. A tuyere for use in treating a bath of molten metal comprising a tubular body member having a mounting flange mounted thereon inwardly of one end thereof and means for introducing gas into the tubular member adjacent said one end thereof, a chamber formed in said one end for receiving said gas and a plurality of small tubes communicating with said chamber and extending from said one end of said tubular body member to a discharge end thereof, a first portion of said small tubes being positioned in parallel relation to one another in a first portion of said tubular body member inwardly of said chamber and a second portion of said small tubes arranged in a spiral cofiguration engaging the inner surface of said tubular body member and extending to said discharge end of said tuyere, a refractory core positioned in said tubular body member and in the area defined by said small tubes and a portion of each of said small tubes inwardly of said discharge end of said tuyere being partially flattened to form a modified oval shape whereby the ends of each of said small tubes forms an elongated narrow opening arranged to discharge gas into said molten metal bath tangentially with respect to said tuyere.

2. The tuyere for use in treating a bath of molten metal set forth in claim 1 and wherein each of said plurality of small tubes in said second portion thereof arranged in a spiral configuration is partially flattened to form an elongated narrow opening for gas directed therethrough.

3. The tuyere for use in treating a bath of molten metal set forth in claim 1 and wherein said tuyere is located in an opening in a vessel adjacent the bottom thereof in which said bath of molten metal is positioned and wherein said mounting flange positions said tuyere in said opening in fluid tight relation.

4. The tuyere for use in treating a bath of molten metal set forth in claim 1 and wherein said tuyere is located in an opening in a vessel adjacent the bottom thereof in which said bath of molten metal is positioned and wherein said mounting flange positions said tuyere in said opening in fluid tight relation and wherein said means for introducing gas into said tubular member adjacent one end thereof comprises fittings on said tubular body outwardly of said mounting flange.

5. The tuyere for use in treating a bath of molten metal set forth in claim 1 and wherein said tubular body member is cross sectionally circular and wherein said first portion of said small metal tubes positioned in parallel relation to one another are arranged in a circular pattern registering with said cross sectionally circular tubular body member.

6. The tuyere for use in treating a bath of molten metal set forth in claim 1 and wherein said second portion of said small tubes arranged in a spiral configuration are arranged in a circular pattern registering with said cross sectionally tubular body member whereby gas directed through said small metal tubes enters said bath of molten metal in a plurality of tangential paths.

* * * * *